United States Patent [19]

Sakamoto

[11] 4,052,875

[45] Oct. 11, 1977

[54] SMALL SIZE, PORTABLE BENDER

[75] Inventor: Kaneaki Sakamoto, Chigasaki, Japan

[73] Assignee: Kabushiki Kaisha Ogura Chuck Seisakusho, Japan

[21] Appl. No.: 712,144

[22] Filed: Aug. 6, 1976

[30] Foreign Application Priority Data

| | | |
|---|---|---|
| Aug. 30, 1975 | Japan | 50-105325 |
| Nov. 21, 1975 | Japan | 50-139997 |

[51] Int. Cl.[2] ..... B21D 7/024

[52] U.S. Cl. ..... 72/217; 72/387; 72/444

[58] Field of Search ..... 72/217, 216, 388, 387, 72/36, 444

[56] References Cited

U.S. PATENT DOCUMENTS

| | | | |
|---|---|---|---|
| 947,288 | 1/1910 | Anderson | 72/388 |
| 1,133,401 | 3/1915 | Redding | 72/217 |
| 1,217,488 | 2/1917 | Myers | 72/217 |
| 1,795,188 | 3/1931 | Wagenbach | 72/388 |
| 2,279,389 | 4/1942 | Delaney | 72/447 |

*Primary Examiner*—C.W. Lanham
*Assistant Examiner*—Gene P. Crosby
*Attorney, Agent, or Firm*—Carroll F. Palmer

[57] ABSTRACT

A small size, portable bender operable from a domestically available A.C. source of the order of 100V having the drive shaft turned through the intermediary of a clutch from a motor to perform a bending operation. Bending angle control means is provided to regulate the clutch to discontinue the bending operation at a desired angle.

4 Claims, 7 Drawing Figures

SMALL SIZE, PORTABLE BENDER

BACKGROUND OF THE INVENTION

This invention relates to a small size, portable bender for bending a steel rod or tube on the spot.

A majority of the conventional bending machines of steel rods and the like are of a great scale which have to be permanently installed in a factory for the operation, and there have recently been demands for a bending machine capable of being transported and easily placed on the spot by the hands of a user himself without involving any other expedients, and operated by an A.C. electric power source of the domestic order of 100 volts.

SUMMARY OF THE INVENTION

Accordingly, one of the objects of this invention is to provide an automatic bender of compact structure transportable for operation on the spot.

Another object of the invention is to provide an automatic, portable bender operable by an A.C. electric power source of the domestic order of 100 volts.

Still another object of the invention is to provide an automatic, portable bender in which an angle at which a steel rod or the like is bent can be freely adjusted in a simple, convenient manner.

DESCRIPTION OF THE PREFERRED EMBODIMENTS

Figure 1:
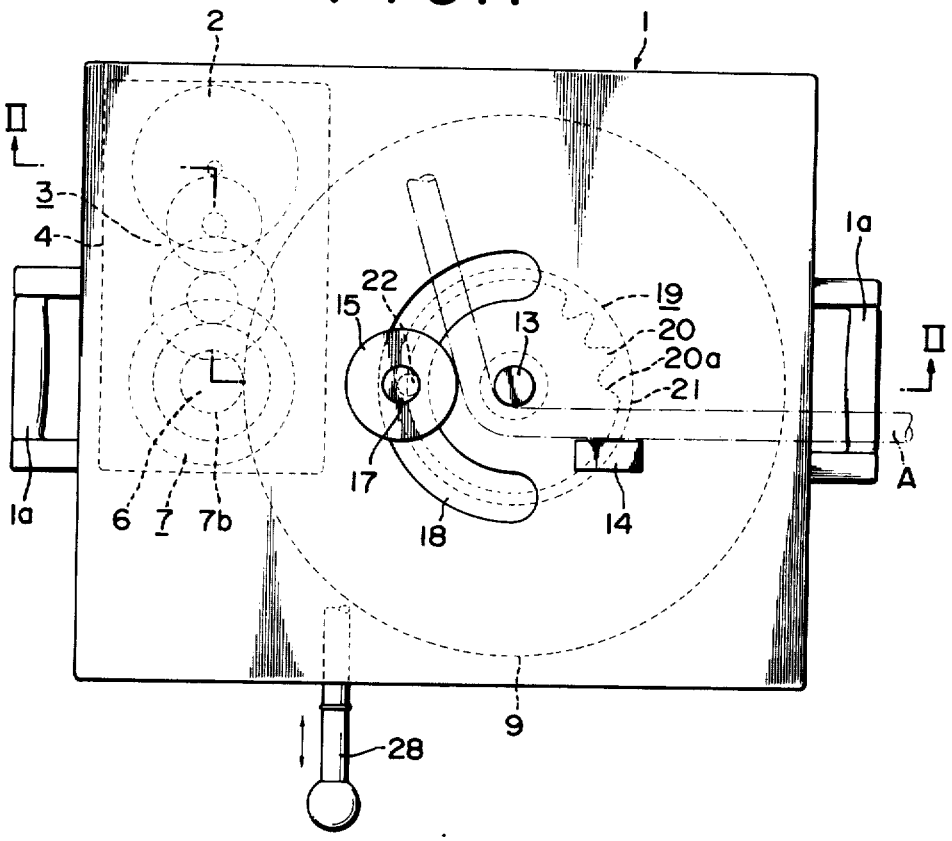
FIG. 1 schematically shows a plain view of one embodiment of the invention.
Figure 2:
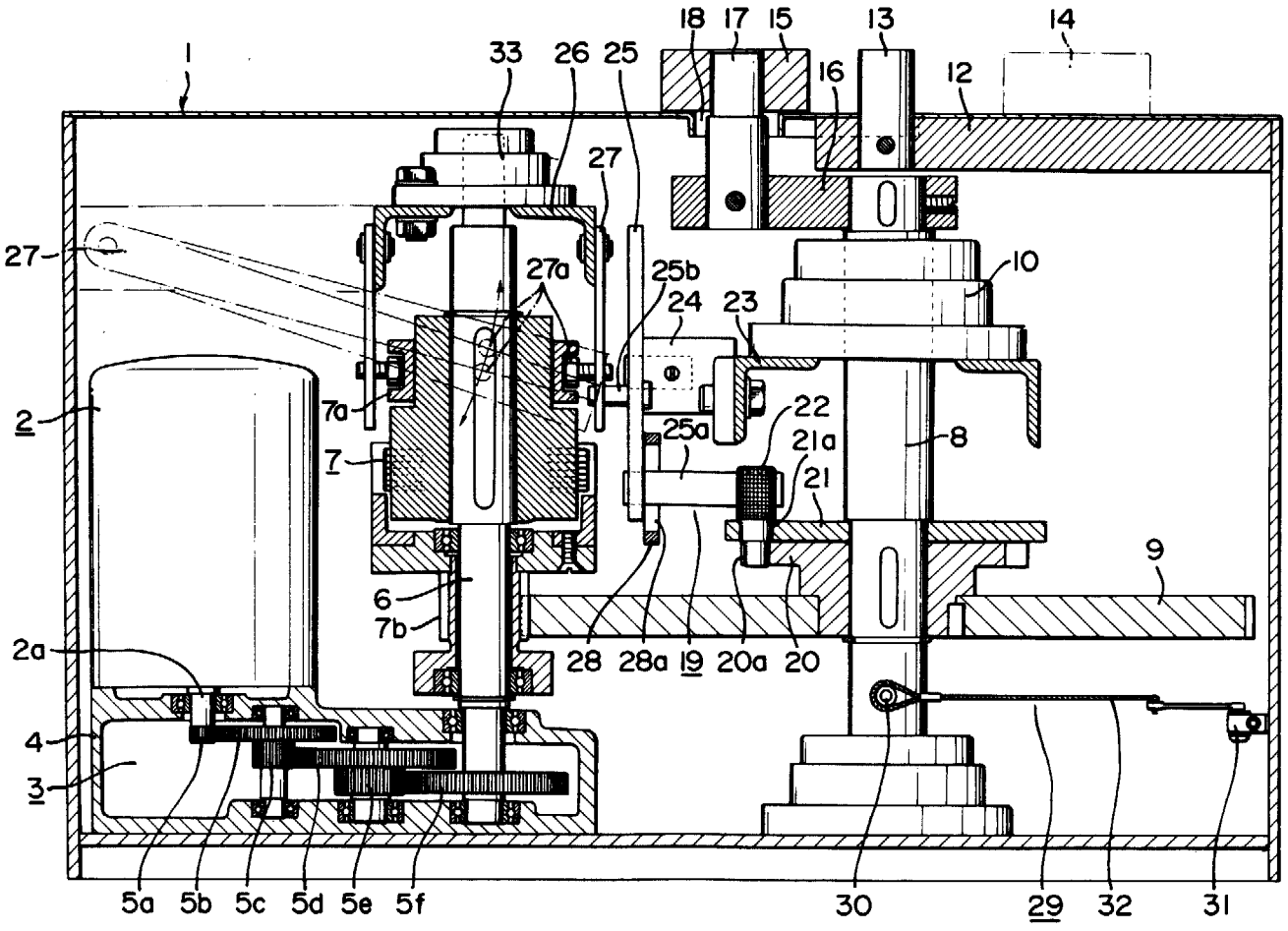
FIG. 2 is a cross-sectional view along line II—II of FIG. 1.
Figure 4:
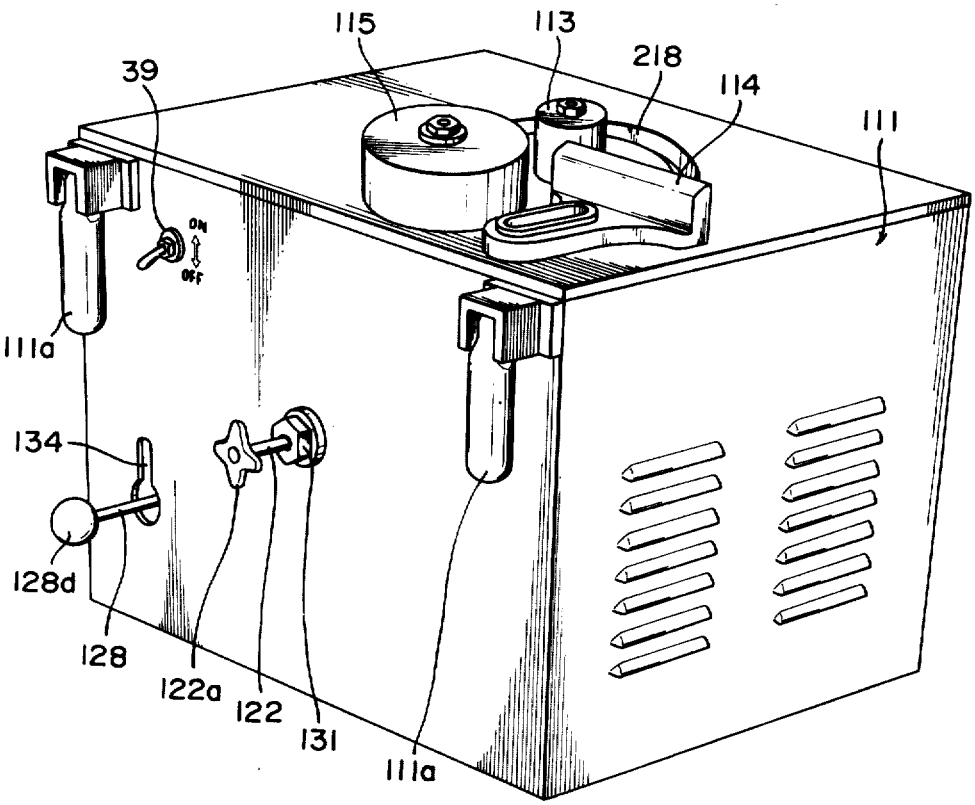
FIG. 4 is a perspective view of a second embodiment of the invention.
Figure 5:
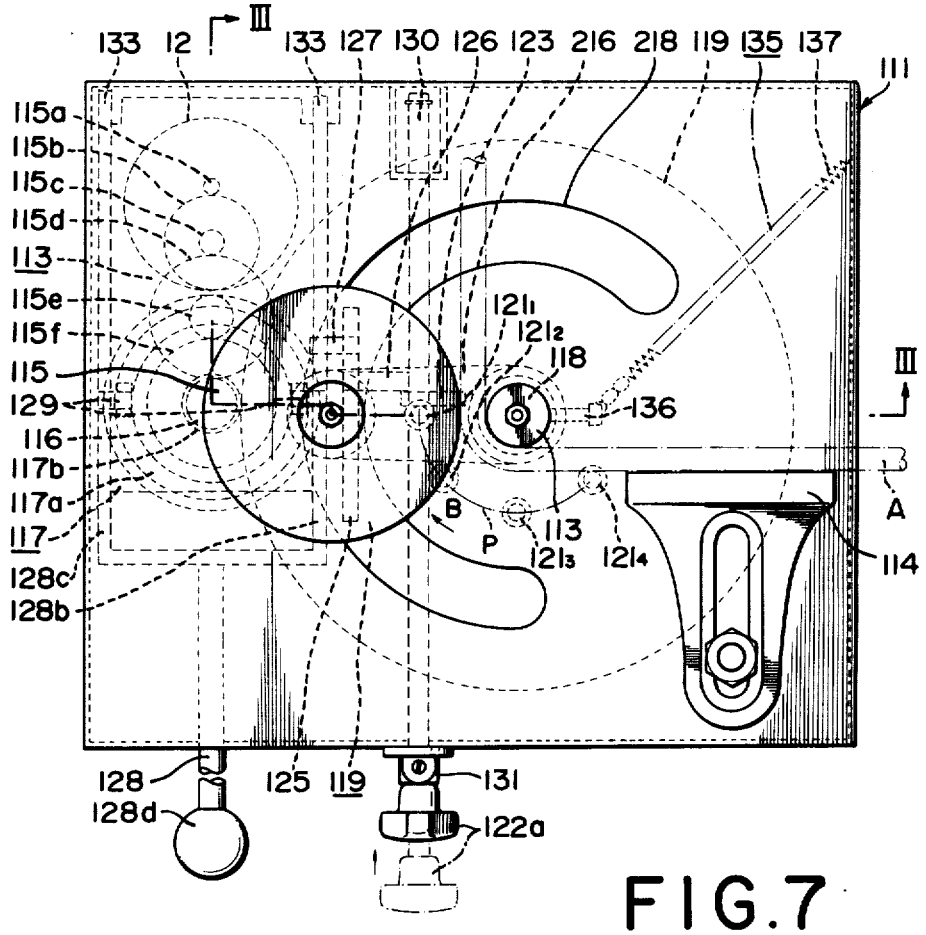
FIG. 5 shows a plain view of the second embodiment.

Referring to FIGS. 1 and 2 of the drawings, the bender embodied by the invention includes a generally cubiform case body 1 made of a suited light metal and in a small size enough to permit transportation by one's hands and provided on the lateral walls with suitable handles 1*a*, 1*a* to facilitate handling in transportation. Within the case body 1 are disposed an electric motor 2 and a reduction gear unit 3 which are located on the bottom wall adjacent one corner of the case body 1. The motor 2 is a miniature single-phase commutator motor operable from a domestically available A.C. source of the order of 100V to produce a relatively great starting moment, and have a relatively small weight to facilitate transportation of the bender. This reduction gear unit 3 comprises a series of wheels 5*a*, 5*b*, 5*c*, 5*d*, 5*e*, and 5*f* housed in a compact casing 4 on which the motor 2 is mounted adjacent one end thereof. The first wheel 5*a* of the gear unit is rigidly formed on the lower end of a motor shaft 2*a* of the motor 2 the rotation of which may be reduced in velocity and transmitted to the output wheel 5*f*.

The output wheel 5*f* is rigidly secured to the end periphery of a rotatable clutch shaft 6 which extends through a casing of the reduction gear unit 3 upwardly to terminate in a pillow block 33 supported on a frame 26. A clutch 7 is disposed on the intermediate periphery of the clutch shaft 6 and is axially slidable along the shaft 6 by a shifter 7*a* whereby to connect and disconnect transmission of the rotation of the clutch shaft 6 to a pinion 7*b* disposed idly around the saft 6 at a lower position of the clutch 7 and meshingly engaged with a large diameter toothed wheel 9 which is rigidly disposed on an upstading drive shaft 8. The drive shaft 8 is turnably placed at the upper and the lower ends on pillow blocks 10 supported by a frame 23 on a position of the case body and 11 disposed on the lower plate of the case body.

A reinforcing plate 12 is suspended on the inner surface of an upper plate of the case body 1 and forms a base on which s stationary shaft 13 and a rectangular stopper block 14 for a member to be bent are protruding through the upper plate of the case body 1. The stationary shaft 13 is positioned coaxial with the drive shaft 8 and substantially central of the case upper plate, whereas the stopper block 14 is located in a position shifted to a slightly lateral and front side, so that a member A to be bent may be inserted as shown in FIG. 1. The drive shaft 8 has an arm 16 radially secured to the upper end thereof, and the arm 16 rigidly carries an upstanding rotary shaft 17 at the radially outer end. An arcuately elongated slot 18 is formed in the case upper plate through which the rotary shaft 17 is protruding. A bending roller 15 is rotatably mounted around the protruding end of the shaft 17 whereby the bending roller 15 may be moved along the arcuate slot 18, i.e. in an eccentrically spaced path from the stationary shaft 13, as shown in FIG. 1.

A bending angle control mechanism, generally designated by 19 in FIG. 2, which functions to disconnect the clutch 7 during turning of the drive shaft 8 is incorporated in the bender. A sprocket gear 20 of a suitably large diameter is coaxially disposed on the upper side of the large diameter wheel 9 of the drive shaft 8, and has the upper surface on which a free rotary plate 21 lies, the latter being disposed coaxially of the drive shaft 8. The rotary plate 21 has one single through bore 21*a* formed adjacent the outer periphery and adapted to releasably receive an adjustor pin 22 which extends therethrough and whose distal end is capable of being engaged in one of a plurality of sprocket recesses 20*a* of the sprocket gear 20. A rotary operator disc 25 is mounted on the support frame 23 of the upper pillow block 10 by the intermediary of a mount member 24 for horizontal rotation adjacent the clutch 7, and is provided radially adjacent the periphery with a pin 25*a* extending in the opposite direction to the clutch to be adapted to abutting movement by the adjustor pin 22 upon rotation of the latter to a determined position, and also radially with a pin 25*b* extending toward the clutch 7. A lever 27 is pivoted at an upper end on a location of the support frame 26 of the pillow block 33 so as to be adapted to be lifted from a position shown in dotted lines to that shown in doubledotted lines shown in FIG. 2 by action of engagement with the pin 25*b* of the operator disc 25 upon rotation of the latter. The lever is provided with a bolt-like protrusion 27*a* at a suited intermediary position and is engaged in the shifter 7*a* of a recessed section of the clutch 7. In order that the operator disc 25 may be manually turned to lift the shifter 7*a* through the swingeable lever 27, an operating handle rod 28 having an elongated slot 28*a* formed to loosely fit therein the pin 25a of the operator disc 25 is provided to extend through the front plate of the case body. The rod 28 can be normally reciprocated in the front and the rear direction of the body case.

An elastic restoring mechanism, generally designated by 29 in FIG. 2, is provided in an adjacent position to the lower end of the drive shaft 8 to normally urge the latter to turn to a determined position. A setscrew 30 is threadedly planted on the drive shaft 8 adjacent the lower end, and a universal joint 31 is disposed on the inner surface of the lateral plate of the case body 1. A length of elastic wire 32 is tensionally interposed between the setscrew 30 and the joint 31 to provide the elastic restoring mechanism.

In operation, after a member A to be bent has been inserted between the stationary shaft 13 and the stopper block 14 disposed on the upper plate of the case body 1 and a switch(not shown) of the motor 2 has been turned on, rotation of the motor 2 causes the clutch shaft 6 to be rotated at a low speed through the series of wheels 5a to 5f of the reduction unit 3, and also the pinion 7b to be driven through the clutch 7 as the latter is lowered by the self-gravity to connect the transmission. Thus the drive shaft 8 is turned through the wheel 9 against the elastic bias of the wire 32 of the elastic restoring mechanism 29, when the bending roller 15 while rotated on its own axis is turned around the stationary shaft 13 by the intermediary of the arm 16 and the rotary shaft 17, whereby a member A inserted is force bent. During the bending action, a great load is applied to the motor 2 which can overcome the load because of the inherent properties of a single-phase rectifier motor thereby to bend a member A effectively into a shape shown in phantom of FIG. 1. When a member A has been bent to a determined angle, that is to say, the drive shaft 8 has been turned to a determined angle, an adjustor pin 22 preliminarily set in a determined position reaches a determined position in which it abuts against the pin 25a of the operator disc 25 to turn the latter so that the pin 25b of the disc 25 moves to lift the swingeable lever 27 having the protrusion 27a in turn raising the clutch 7. This disconnects transmission of rotation of the clutch shaft 6 to the pinion 7b, thereby to discontinue turning of the drive shaft 8 so that a member A is not bent to any greater angle.

The foregoing operation completes bending of one member A and the drive shaft 8 is turned by the biasing action of the elastic wire 32 into the initial rotary position with the bending roller 15 and the various movable components of the angle control mechanism 19 being restored to the initial positions, so that the clutch 7 is permitted to be lowered to the clutching position for the next bending action.

The bending angle may be suitably changed by the bending angle control mechanism 19. Specifically, prior to a bending action, the free rotary disc 21 is manually turned while the adjustor pin 22 is disengaged from the sprocket recesses 20a of the sprocket wheel 20, thereby to select another sprocket recess 20a of the wheel, and then the adjustor pin 22 is depressed to fit into the selected sprocket recess 20a. It is apparent that the drive shaft 8 may thus be turned to a varied angle at which the adjustor pin 22 comes to operatively abut against the pin 25a of the operator disc 25.

Figure 3:
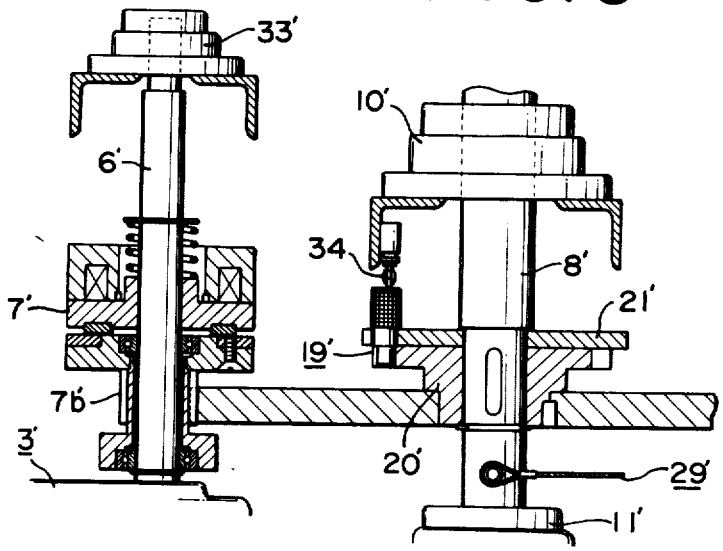
FIG. 3 is a cross-sectional view showing some portions of one modification of the embodiment of FIG. 1.

A first modification of the invention is constructed by the similar components, but in which the clutch 7 is replaced with an electromagnetically operated clutch 7' with a limitor switch 34 instead of the operator disc 25, as shown in FIG. 3 wherein the similar elements as those of the above described embodiment are designated by the same reference numbers, and they are to be deleted in the description. The limiter switch 34 is mounted on the pillow frame to be adapted to be actuated by the adjustor pin 22' which comes to abut against the limitor switch upon turning of the drive shaft 8'. The electromagnetic clutch is electrically coupled to the limiter switch so as to be operated responsive to turning on and off of the latter.

Referring to FIGS. 4 to 7, there is shown a second modification of the invention in which a generally cubiform case body 111 constructed of material and in size enough to permit transportation by one's hand as in the aforementioned embodiment includes therein a miniature single-phase commutator motor 112 operable form a domestically available A.C. source of the order of 100V and a reduction gear unit 113 coupled with the motor to provide a similar drive force source as in the aforementioned embodiment in both the construction and the function.

The output wheel 115f is rigidly secured to the end periphery of a rotatable clutch shaft 116 which extends through a casing of the reduction gear unit 113 upwardly to terminate in a pillow block 133 supported on a portion of the case body. As in the aforementioned embodiment, a clutch 117 is disposed on the intermediary periphery of the clutch shaft 116 to be operatively move along the shaft 116 by action of a shifter 117a. But a pinion 117b transmission of rotation of the shaft 116 to which may be connected and disconnected by means of the clutch 117 is positioned around the shaft 116 at a higher location than the clutch 117. The pinion 117b is meshingly engaged with a large diameter toothed wheel 119 which is rigidly disposed on an upstanding drive shaft 118. The drive shaft 118 is rotatably placed at the upper and the lower end on pillow blocks 110 mounted on the upper plate and 111 disposed on the lower plate of the case body.

A bending arrangement which is constituted by a stationary shaft 113 and a substantially T-shaped stopper block 114 disposed on the outer surface of a reinforcing plate 112, and by a radial arm 116 depending on the shaft 118 and having a rotary shift 117 secured at a distal end for operatively moving a bending roller 115 along an arcuate slot 218 is similar to the corresponding arrangement of the aforementioned embodiment and is to be omitted from the description. But according to this modification, a more rugged bending arrangement is provided by disposing the reinforcing base plate 112 to overlie an end-to-end area of the surface of the case upper plate; diametrically enlarging the bending rollers 115; sheathing the stationary shaft 113 with a reinforcement 113a; shaping the radial arm 116 of the drive shaft 118 into a more sturdy configuration; and using any other expedients. Similarly, an elastic restoring mechanism 135 is formed in a similar manner as in the mechanism 29 of the aforementioned embodiment but by two lengths of elastic wires 137 secured to the drive shaft 118 by means of setscrews 136.

Figure 7:
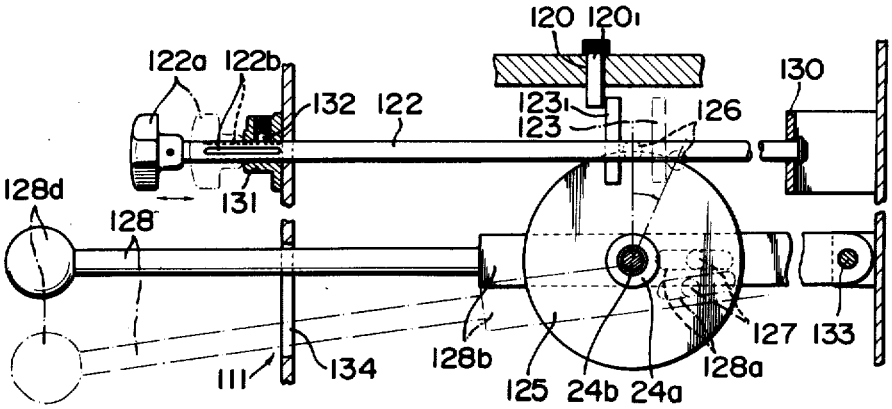
FIG. 7 is a cross-sectional view showing some portions of the second embodiment.
Figure 6:
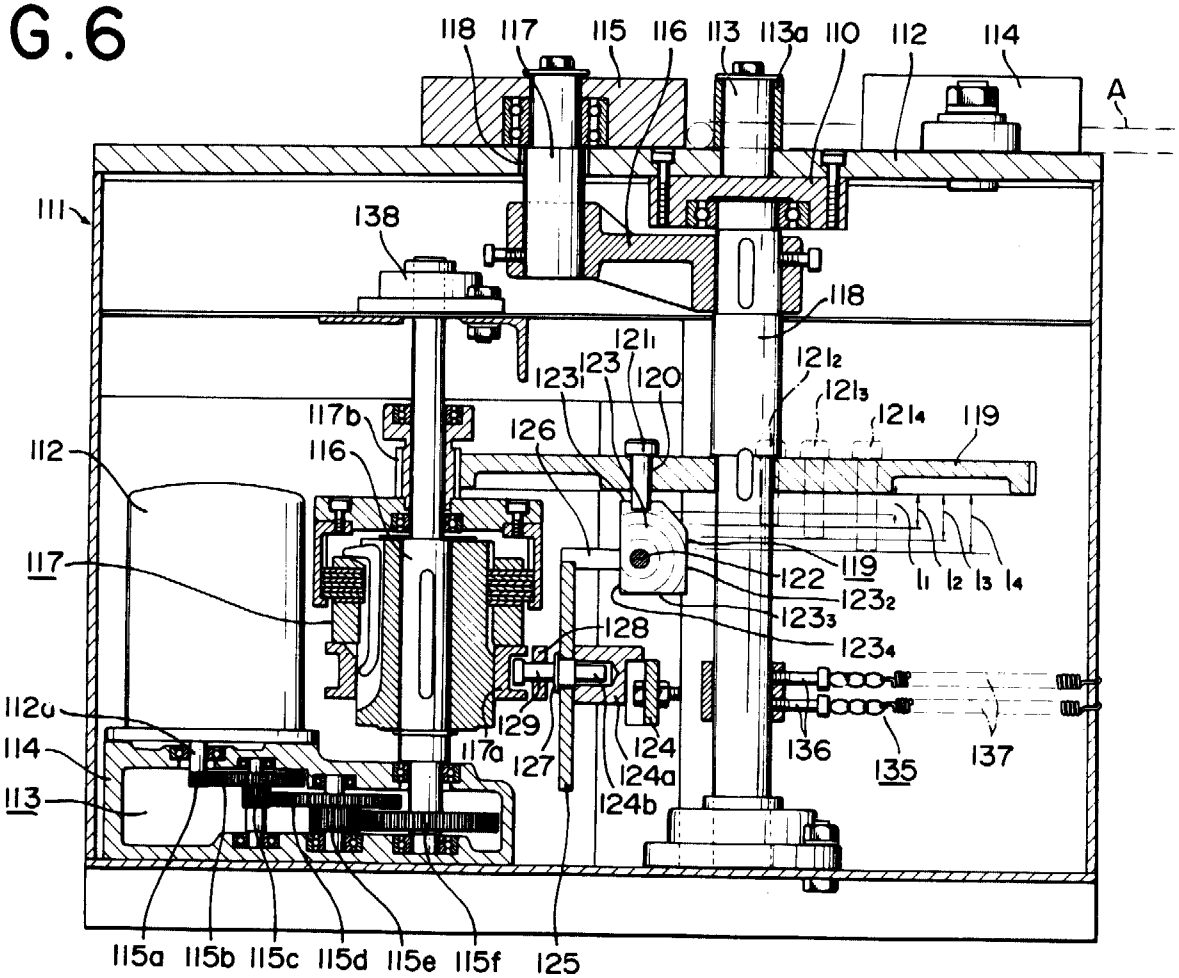
FIG. 6 is a cross-sectional view along line III—III of FIG. 5.

The modification is substantially distinguished from the aforementioned embodiment-in a bending angular mechanism generally designated at 119 in FIG. 6. The large diameter wheel 119 engaged with the pinion 117b is provided on the same circumferential line P (FIG. 5) with a plurality of studs 120, say four studs $121_1$, $121_2$, $121_3$, and $121_4$ spaced at an equal distance in the circumferential direction and protruding downwardly from the underside to distances $1_1$, $1_2$, $1_3$, and $1_4$ which differ from one another to be increased toward the opposite direction to the direction of turning of the drive shaft 118. A responsive plate 123 is arranged adjacent the underside of the wheel 119 to be abuttingly engaged with one of the studs $121_1$, $121_2$, $121_3$ and $121_4$ and physically carried in a vertical posture by a bending angle control rod 122 extending from the rear plate through the front plate of the case body as described herein after in detail. A rotary disc is mounted on a horizontal shaft **124*b* disposed in a bracket 124*a* of a frame 124 attached to be case body to be adapted to a horizontal turning adjacent the clutch 117, and is provided at the circumference with a pin 126 protruding in one side to a degree enough to be engaged with the responsive plate 123 on the control rod 122 when the responsive plate 123 is moved toward the rear plate of the case body. The rotary disc further has a pin 127, as clearly shown in FIG. 7, mounted in a position on the other side adjacent the circumference and shifted at an angle, say 90° from the position of the above mentioned pin 126. The pin 127 is protruding at a distance enough to loosely engage in an elongated slot 128*a* formed in one side member 128*b* of a clutch change-over rod 128. The one side member 128*b* and the other side member 128*c* are extending adjacent opposite lateral sides of the clutch 117 to each terminate at a pivot pin 133 disposed on the inner surface of the rear plate of the case body, and also extending as the clutch change-over rod 128 through an opening 134 in the front plate of the case body to form a grip 128*d* at the outer extremity positioned outside of the case body, whereby the rod 128 may be swinged at the pins 133. The opposite side members 128*b* and 128*c* each have a pin 129 mounted, say, in an aligned position to the axial shaft 124*b* of the rotary disc 125, to protrude into engagement of the above mentioned shifter 117*a* of the clutch 117. The bending angle control rod 122 which rigidly carries the responsive plate 123 has the inner end loosely received in a support member 130 depending on the rear plate of the case body and is extending through a sleeve-like member 131 disposed on the outer surface of the front plate of the case body to protrude therefrom as shown in FIG. 7. A thumb knob 122*a* is mounted on the protruding end of the control rod 122, and the control rod 122 can be turned manually by the thumb knob 112*a* between four angular positions spaced at 90°. The control rod 122 is to be also axially moved at each 90° angular position. To angularly position the control rod and ensure the axial movement at one angular position, four grooves 122*b* are formed on the circumference of the control rod in the 90° spacing and extending at a determined length in the axial direction thereby to receive a guiding sleeve 132 resiliently disposed in the sleeve-like member 131. The responsive plate 123 carried by the control rod in the intermediary portion adjacent the studs 120 of the large diameter wheel 119 is shaped to form four sides $123_1$, $123_2$, $123_3$ and $123_4$ each having different heights from the axis of the control rod so that each one of the four sides at a selected particular angular position of the control rod becomes positioned to face the underside of the large diameter wheel 119 and may be engaged with the corresponding one of the studs 120**.

In use, when a member A should be bent to 90° for instance, the thumb knob **122*a* is manipulated at the thumb knob to turn step-by-step at 90° the bending angle control rod 122 whereby the most highest one $123_1$ of the four sides of the responsive plate 123 is preset to face the underside of the large diameter wheel 119. Thus, upon energizing the motor 112, the drive shaft 118 is drive turned through reduction gear unit clutch shaft, clutch, pinion and large diameter wheel so as to bend a member A between the shaft 113 and the block 114 by the roller 115, and when the drive shaft has turned to 90°, the one $121_1$ of the studs 120 which has the shortest protruding length $1_1$ is engaged with the side $123_1$ of the responsive plate 123 to move the latter into a position shown in phantom in FIG. 7. The rotary disc 125 is thereby turned in the direction C of FIG. 7 through the pin 126 engaged by the responsive plate 123, whereby the clutch change-over rod 128 is pivotally lowered through the engagement of the pin 127 in the groove 128*a* into a position in phantom of FIG. 7. The pin 129 planted on the rod 128 then depresses the shifter 117*a* disposed in each lateral side of the clutch 117 thereby to permit the latter to disconnect the clutch shaft 116 away from the pinion 117*b*. The drive shaft 118** thus discontinues any further turning to stop the bending action at 90°.

This completes the one bending action and the elastic restoring mechanism 135 then functions in a similar manner as in the aforementioned embodiment to restore the drive shaft 118 into the initial position for the next action. After a member A having been bent into the preceeding action is replaced with the next one, and the clutch change-over rod 128 is manipulatedto be pivotally raised whereby the rotary disc 125 is turned back to the initial position by the pin 127 engaged in the groove **128*a* thereby to move the responsive plate 123 together with the rod 122 into the initial position. At the same time the shifter 117*a* is raised to clutch the clutch shaft 116 to the pinion 117*b* by the clutch 117 thereby to start the next bending action. It is apparent that the motor 112** can be kept in operation between each bending action.

To change a set bending angle to another, or to change it for one bending action from that set in the preceeding action, the bending angle control rod 122 is manipulated from the thumb-knob to axially turn the rod 122 step-by-step at 90° so that a desired one of the four sides $123_1$, $123_2$, $123_3$ and $123_4$ of the responsive plate 123 is set to face the underside of the large diameter wheel 119. This manipulation can be made between each bending action when the clutch 117 is disconnecting the clutch shaft 116 from the pinion **117*b* with the clutch change-over rod 128 being postured in the lower position as shown in phantom in FIG. 7. Suppose that the second highest side $123_2$ is thus set to face the underside of the wheel 119. The wheel 119 and accordingly the drive shaft 118 continues turning because the stud $121_1$ of the shortest protruding length $1_1$ of the wheel 119 passes above the side $123_2$, until the stud $121_2$ of the second shortest length $1_2$ comes to abut against the side $123_2$ of the responsive plate 123 when the bending action is discontinued at the corresponding different angle. If any other of the sides of the responsive plate 123 is selected, a bending angle which correspondingly differs can be obtained in a similar manner as above described. It is obvious that the protruding studs of the wheel 119 may be modified in number and spacing length in order to provide a desired number of the bending angles to be selected. Of course, the sides of the responsive plate 123** are to then correspondingly be modified to the purpose. The second modification is advantageous in that a desired bending angle can be set by a simple manipulation from without the case body of the bender without removing the upper plate for accession of the interior.

Accordingly, an automatic bender is provided by the invention, which is constructed in such a compact structure that it can be transported by the hands of a user himself without involving any other expedients; is operable on the location so far as an A.C. electric source of the domestic order of 100V is available therein; and is capable of selecting any desired bending angle to be set.

What is claimed is:

1. A portable bender having a case body which is small in both size and weight enough to permit transportion of said bender by the hands of a user, and therein comprising a miniature, single-phase commutator motor, a drive shaft, a reduction gear mechanism for transmitting a rotational drive force from said motor to said drive shaft, clutch means for connecting and disconnecting the transmission of said rotational drive force to said drive shaft, a stationary shaft disposed coaxially of said drive shaft to protrude through said case body, stopper block means for a member to be bent disposed on the outer surface of said case body to be spaced at a determined distance from said stationary shaft, a slot formed in said outer surface arcuately elongated around the center of said stationary shaft, a bending roller provided on said outer surface and so linked to said drive shaft as to be turned along said arcuately elongated slot for applying a bending force to a member to be bent, bending angle control means operable to cause said clutch means to disconnect said rotational drive force from said drive shaft when said drive shaft has turned to a determined angle, and elastic means for restoring said drive shaft to the initial position when said clutch has disconnected said rotational drive force from said drive shaft.

2. The portable bender defined in the claim 1 wherein said bending angle control means includes actuator means for actuating said clutch means and at least one member carried on said drive means and thereon placed in a number of determined positions spaced from each other in the direction of the turning of said drive shaft and having distances relative with said actuator means whereby said member cooperates with said actuator means when said drive shaft has been turned to a corresponding angle to the selected one of said determined positions to cause said clutch to disconnect said rotational drive force from said drive shaft.

3. The portable bender defined in claim 1 wherein said bending angle control means includes actuator means for actuating said clutch means, a plurality of members carried on said drive shaft in a number of determined positions spaced from each other in the direction of the turning of said drive shaft and having distances relative with said actuator means, and each having a different length protruding from said drive shaft toward said actuator means, and means for selecting one of said members which cooperates with said actuator means when said drive shaft has been turned to a corresponding angle to one of said determined positions occupied by said selected one member thereby to cause said clutch to disconnect said rotation drive force from said drive shaft.

4. The portable bender defined in claim 1 wherein said clutch means is electromagnetically operable and said bending angle control means includes electric switch means.

* * * * *